US007314011B2

(12) United States Patent
Cattaneo

(10) Patent No.: US 7,314,011 B2
(45) Date of Patent: Jan. 1, 2008

(54) FOLD-AWAY LEGS FOR SUPPORT SURFACES

(75) Inventor: Carlo Cattaneo, Figino Serenza (IT)

(73) Assignee: Leonardo S.r.l., Figino Serenza (IT)

( * ) Notice: Subject to any disclaimer, the term of this patent is extended or adjusted under 35 U.S.C. 154(b) by 212 days.

(21) Appl. No.: 10/507,967

(22) PCT Filed: Mar. 20, 2003

(86) PCT No.: PCT/EP03/02918

§ 371 (c)(1),
(2), (4) Date: Apr. 13, 2005

(87) PCT Pub. No.: WO03/082051

PCT Pub. Date: Oct. 9, 2003

(65) Prior Publication Data

US 2005/0172868 A1 Aug. 11, 2005

(30) Foreign Application Priority Data

Mar. 29, 2002 (IT) ..... MI2002A0662

(51) Int. Cl.
*A47B 3/00* (2006.01)

(52) U.S. Cl. ..... 108/127; 108/133; 248/439

(58) Field of Classification Search ..... 248/188.6, 248/188, 150, 439, 166; 108/169, 174, 124, 108/126, 127, 129, 130, 131, 132, 133
See application file for complete search history.

(56) References Cited

U.S. PATENT DOCUMENTS

| | | | | |
|---|---|---|---|---|
| 3,491,706 | A | 1/1970 | Glass | |
| 3,604,372 | A * | 9/1971 | Hewett et al. | 108/160 |
| 3,643,975 | A * | 2/1972 | Parkhurst | 280/475 |
| 5,845,589 | A * | 12/1998 | Pfister | 108/132 |
| 5,974,982 | A * | 11/1999 | Lepper et al. | 108/132 |
| 6,386,119 | B1 * | 5/2002 | Lin | 108/133 |
| 6,394,005 | B1 * | 5/2002 | Isensee et al. | 108/132 |
| 2003/0167980 | A1 * | 9/2003 | Suzuki | 108/129 |
| 2005/0235886 | A1 * | 10/2005 | Koning et al. | 108/132 |

FOREIGN PATENT DOCUMENTS

| | | |
|---|---|---|
| CH | 690 641 | 11/2000 |
| EP | 1 050 240 | 11/2000 |

* cited by examiner

*Primary Examiner*—Janet M. Wilkens
(74) *Attorney, Agent, or Firm*—Hedman & Costigan P.C.; James V. Costigan

(57) ABSTRACT

Tubular fold-away legs for support surfaces which includes a joint, which is made up of an element for coupling to the tubular body and an attachment element to said support surface, the legs being mobile between a first closed non-operative position and a second open operative position, tilted by an angle with respect to the support surface. The joint is equipped with elastic locking device to secure it in either the non-operative or operative positions and with a stable attachment device when in the operative position, as well as matching tilted centering surfaces.

13 Claims, 4 Drawing Sheets

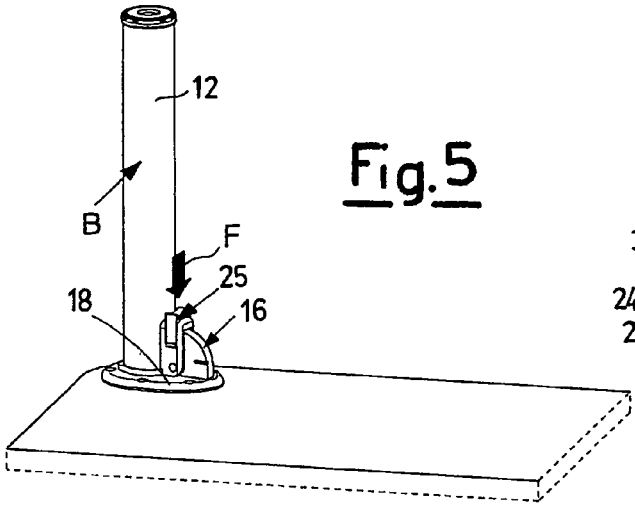
Fig.5
Fig.6
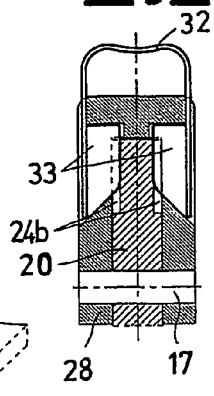
Fig.7
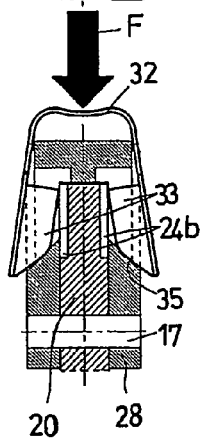
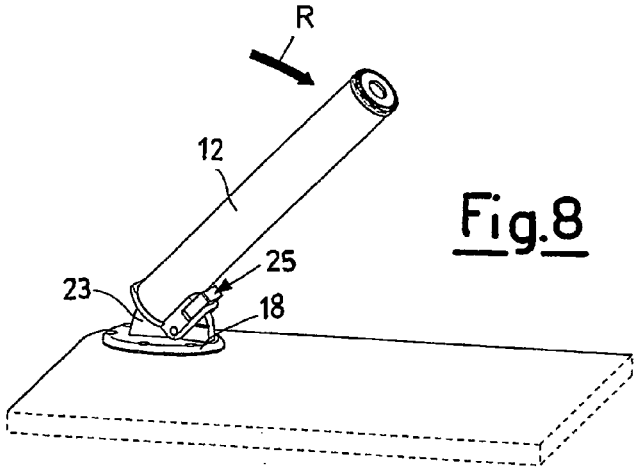
Fig.8
Fig.9
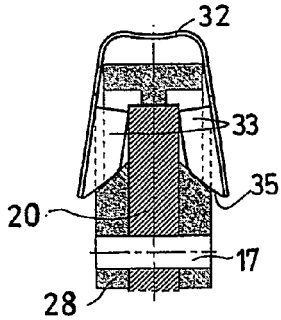
Fig.10
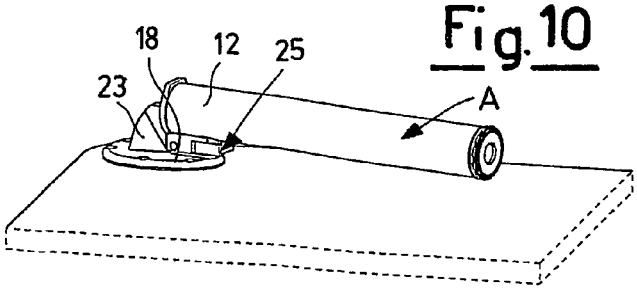
Fig.11
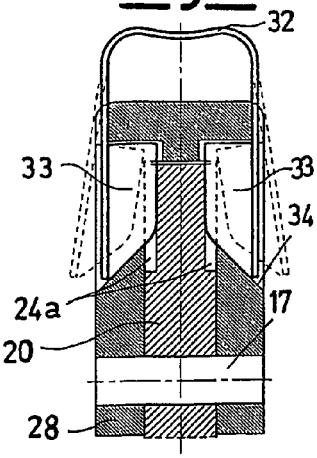

FOLD-AWAY LEGS FOR SUPPORT SURFACES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

The present invention refers to fold-away legs for support surfaces, in particular to tubular legs.

BACKGROUND OF INVENTION

In the field of tables there is a great need to fold the legs towards the surface to allow, for example, piles of tables to be transported with less bulk. Fold-away legs can also be applied more generally to all furniture made up of a support surface supported, indeed, by such legs.

Nevertheless, particularly in the field of tables to be used in meetings, restaurants or group meeting halls, which must frequently be set up or removed and the put back, it is suitable to have fold-away legs which are easy to maneuver, suitable for allowing many tables to be piled up. Stability of the support surface and a good aesthetic result are non-negligible elements.

Currently, the market offers fold-away legs included in complex structures hinged below the support surfaces. Other structures, besides frequently having a non-negligible bulk, are equipped with complicated leverages to be actuated both in the opening and closing step.

Frequently, moreover, fold-away structures associated with legs for support surfaces, currently on the market, significantly weigh down the furniture.

<Tubular fold-away legs for support surfaces representing the closest state of the art of the present invention are known from documents CH--A-690641 and US-A-3491706 and comprise a joint provided with an helicolidal spring which is housed inside of the joint and exerts its force in an axial direction to maintain complementary surfaces of the joint in engagement one inside the other.>

BRIEF SUMMARY OF THE INVENTION

The general purpose of the present invention is that of overcoming the aforementioned drawbacks of the prior art in an extremely simple, cost-effective and particularly functional manner.

Another purpose is that of realising fold-away legs for support surfaces with good stability and above all with fast and easy manoeuvrability.

A further purpose is that of realising fold-away legs which are easy to attach to the surface of the table and adaptable to whatever shape and size of the surface itself.

In view of the aforementioned purposes, according to the present invention, it has been thought of to realise fold-away legs, having the characteristics outlined in the attached claims.

The structural and functional characteristics of the present invention and its advantages compared to the prior art shall become clearer from an examination of the following description, referring to the attached drawings, which show fold-away legs realised according to the innovative principles of the invention itself.

In the drawings:

BRIEF DESCRIPTION OF THE SEVERAL VIEWS OF THE DRAWINGS

FIGS. 5-11 schematically show the closing steps of fold-away legs, object of the present invention, and the corresponding section views of the elastic locking means;

DETAILED DESCRIPTION OF THE INVENTION

With reference to the drawings, fold-away legs for support surfaces in object are wholly indicated with 10, and in the illustrated example, according to the present invention, comprise a tubular body 12 and a joint 13 for articulated coupling with a support surface 14.

Figure 1:
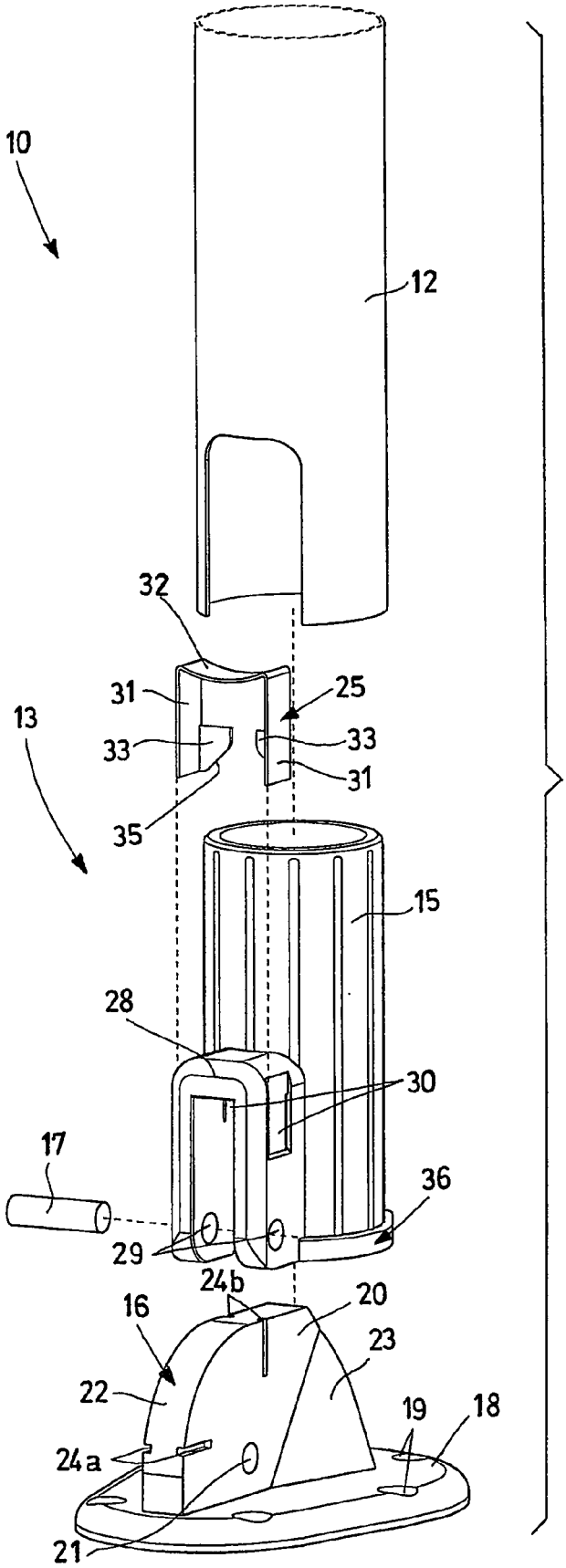
FIG. 1 is an exploded view of a fold-away leg object of the present invention.

The joint 13 consists of an element for coupling with the tubular body 15, for example a sleeve on which such a tubular body 12 is slotted with light interference, and an attachment element 16 to the support surface 14, pivoted together through a rod or through-pin 17 (FIG. 1).

Figure 2:
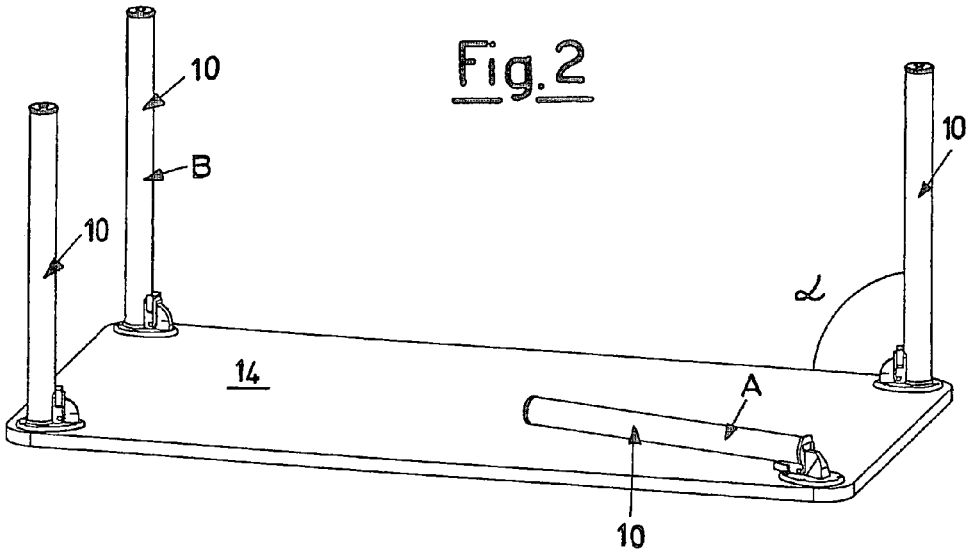
FIG. 2 shows fold-away legs according to the invention applied to a support surface and locked in non-operative and operative position.

The articulated joint 13 allows legs 10 to be mobile between a first closed non-operative position A and a second open operative position B (FIG. 2).

In the closed non-operative position the tubular body 12 of the legs is arranged in a position substantially aligned with the support surface 14, so as to minimise the bulk.

In the open operative position the tubular body 12 is tilted by an angle $\alpha$ with respect to the support surface 14. In the embodiment shown only as an example and not for limiting purposes, the support surface 14 and the tubular body 12 are arranged at a right angle.

In further embodiments which are not shown the legs 10 could be angled differently in operative position with respect to the support surface 14.

The attachment element 16 to the support surface comprises an attachment plate 18, equipped for example with a plurality of holes 19 for screwing into the support surface. Alternatively, the plate 18 could be fixed differently to the support surface.

From the attachment plate 18 a guide wall 20, for the rotation of the sleeve 15 with respect to the plate 18, extends in a normal direction with respect to a plane of rotation 11 of the fold-away leg 10.

In the guide wall 20, in a substantially central position near to the plate 18, a through hole 21 is formed for the insertion of the rotation pin 17.

In the plane of rotation 11, the guide wall 20 has a bevelled profile 22. At one end two wedge-shaped elements 23 extend laterally, which identify tilted centring surfaces with the sleeve.

Figure 3:
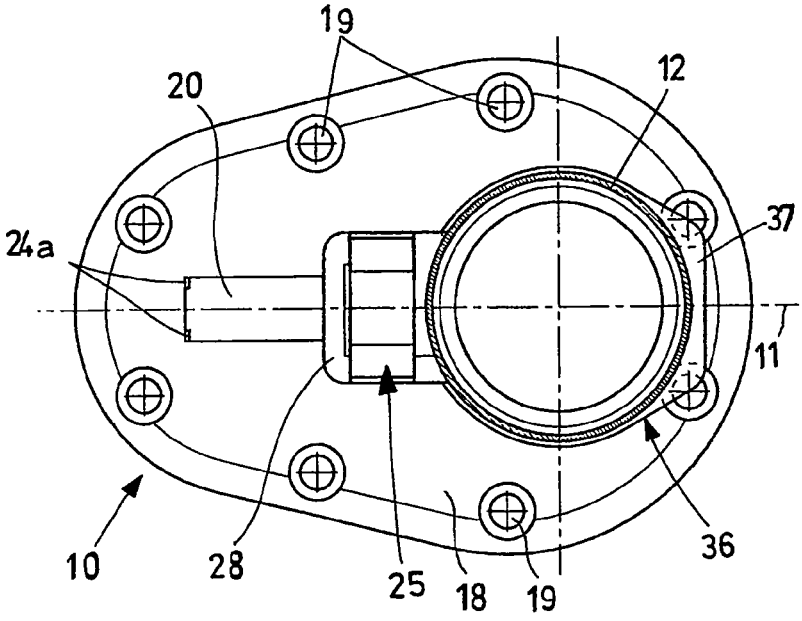
FIG. 3 is a partial section view from above of the fold-away leg of FIG. 1.

The guide wall 20 is also equipped with seats or recesses 24*a*, 24*b* for the intervention of elastic locking means 25, which prevents the relative rotation between sleeve 15 and plate 18 when the leg is respectively in open operative position B (FIG. 3) and in closed non-operative position A.

The seats 24 are arranged in pairs which mirror each other with respect to the plane of rotation 11 on both of the faces of the guide wall 20.

Figure 4:
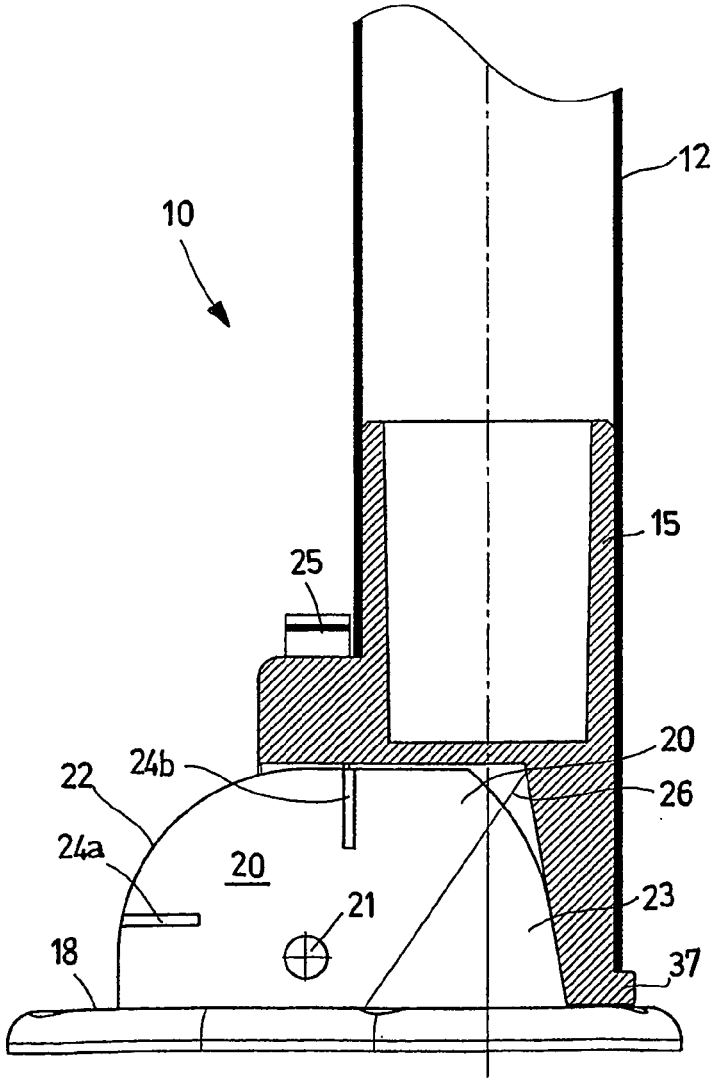
FIG. 4 is a side elevation partial section view of the fold-away leg.

The sleeve 15, coupled with the tubular body 12, is internally hollow and equipped with tilted inner surfaces 26 which match the wedge-shaped elements 23 of the plate 18, to realise a stable coupling with light interference (FIG. 4).

The matching surfaces 23 and 26 of the joint 13 constitute stable attachment means of the tubular body 12 to the support surface 14 in open operative position.

The sleeve 15 is equipped with an opening, from which a forked element 28 extends outwards, on which a hole 29 is realised aligned with the hole 21 of the guide wall 20 for the insertion of the rotation pin 17.

On the fork 28 a pair of through seats 30 are also realised, which are symmetrical with respect to the plane of rotation 11, which receive the elastic locking means 25, like, for example, an elastic U-bolt, consisting of a U-shaped metal sheet.

The U-bolt 25 comprises two side arms 31 and a concave pressing surface 32, on which the user intervenes.

The arms 31 each carry, at their ends, engagement means 33, for example consisting of trapezoidal fins, symmetrical with respect to the plane of rotation 11.

The fins 33, housed in the through seats 30 of the forked element 28, alternately engage, when the leg is in open or closed position, in one of the pairs of seats 24*a* or 24*b* of the guide wall 20 of the attachment plate 18.

The pressure applied on the concave surface 32 of the elastic U-bolt 25 determines a spreading movement of the arms 31 carrying the fins 33, promoted by the presence of tilted planes 34 formed in the through seats 30 and matching outlet edges 35 of the fins 33.

Figure 13:
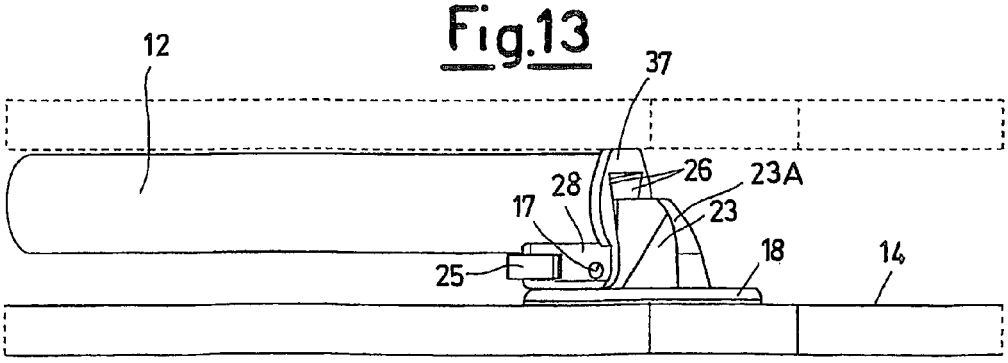
FIG. 13 is a side elevation view of a fold-away leg in closed position.

The sleeve 15 is also equipped with a perimetric collar 36 which, in a position diametrically opposite with respect to the forked element 28, forms an abutment surface 37 for the piling of support surfaces 14 equipped with legs 10 in folded-away position (FIG. 13).

FIGS. 4 and 5 show a fold-away leg 10, object of the present invention, in open operative position, made stable by the forced coupling between the matching tilted centring surfaces 23 and 26, and the curved surface 23A.

The leg 10 is held in such a position by the elastic locking means 25, engaged in the pair of seats 24*b* of the plate 18 (FIG. 6).

The pressure applied on the U-bolt 25 in the direction of the arrow F, induces the sliding of the fins 33 on the tilted planes 34 of the through seats 30 of the sleeve 15, until their disengagement from the seats 24*b* of the attachment element 16 is caused (FIG. 7).

In this situation the user can freely rotate the sleeve 15 with respect to the plate 18 to fold the leg 10 towards the support surface 14, as represented with the arrow R in FIG. 8.

During the rotation it is possible to release the pressure on the U-bolt 25, since the fins 33 abut against the outer surface of the guide wall 20 and thus keep the arms 31 of the elastic U-bolt 25 spread (FIG. 9).

Once the position in which the fins 33 are aligned with the second pair of seats 24*a* of the plate 18 is reached, through the elastic return force applied by the deformed U-bolt 25, the fins 33 automatically engage in the seat 24*a*, as schematised in FIG. 11, holding the leg 10 in the non-operative position of FIG. 10.

The opening steps of the fold-away leg 10, object of the present invention, proceed in a totally analogous way to that which has already been described.

Once the U-bolt has been unhooked through pressing, the leg is rotated up to its stable attachment in open operative position at a right angle with respect to the support surface.

Figure 12:
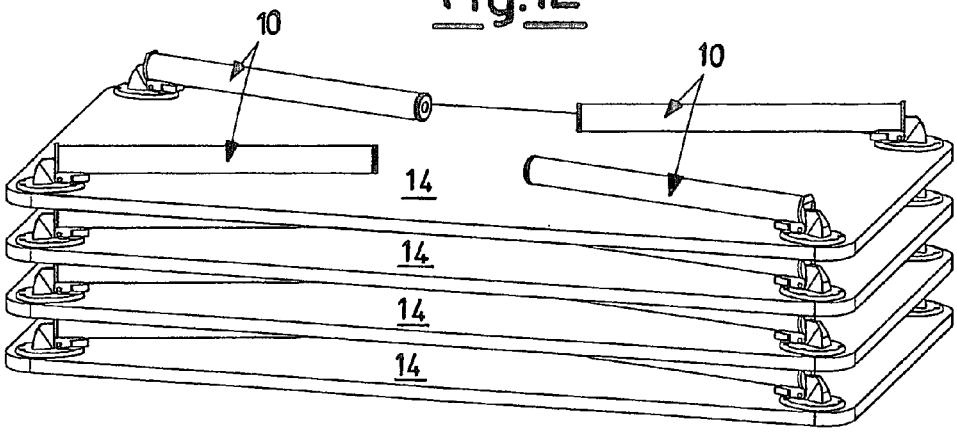
FIG. 12 shows support surfaces piled on top of each other, equipped with fold-away legs in non-operative position.

The attachment plates 18 can advantageously be fixed to the support surface 14, in a position such as not to cause interference between the legs 10 when folded in non-operative position, as represented in FIG. 12.

Moreover, both the element for coupling with the tubular body of the leg 15, i.e. the sleeve, and the attachment element to the surface 16, can advantageously be made both from metal and from plastic. In such a way a joint 13 which is particularly light and cost-effective is obtained.

The fold-away legs for support surfaces, object of the present invention advantageously allow tables to be piled up avoiding possible damage, such as scratching, of the surfaces.

Indeed, in non-operative position the presence of an abutment surface made from plastic allows safe piling of tables.

Another relevant advantage of the fold-away legs according to the invention is that the joint 13 and the relative components are all contained within the leg.

From that which has been described above with reference to the figures, it is clear how fold-away legs for support surfaces according to the invention are particularly useful and advantageous. The purpose mentioned in the preamble of the description is thus accomplished.

Of course, the shapes of the fold-away legs of the invention can be different from those shown as a non-limiting example in the drawings, just as the materials can also be different.

The scope of protection is therefore defined by the attached claims.

The invention claimed is:

1. Tubular fold-away legs for a support surface, each comprising a joint (13), comprising an element for coupling with a tubular body (15), a tubular body (12) capable of being secured to the element for coupling with a tubular body (15), and an attachment element attachable (16) to said support surface (14), said legs (10) being mobile between a first closed non-operative position (A) and a second open operative position (B), tiltable by an angle ($\alpha$) with respect to said surface (14), said joint (13) being equipped with elastic locking means (25) of said two non-operative (A) and operative (B) positions and with stable attachment means (23, 23A and 26) of said operative position (B), comprising matching tilted centering surfaces characterized in that said elastic locking means (25) consists of an elastic U-bolt comprising a central pressing surface (32) and two side arms (31) carrying engagement elements (33) housed in symmetrical through seats (30) of said element for coupling with the tubular body (15) and capable of engaging in pairs of seats (24*a*) or (24*b*) of said attachment element (16).

2. Legs according to claim 1, characterized in that said element for coupling with the tubular body (15) is a sleeve, suitable for being inserted with interference in said tubular body (12).

3. Legs according to claim 2, characterized in that said sleeve (15) is equipped with a perimetric collar (36), suitable for constituting an abutment surface (37) for the piling of support surfaces (14) with said legs (10) in non-operative position (A).

4. Legs according to claim 1, characterized in that said attachment element (16) attachable to said support surface (14) is a perforated attachment plate (18).

5. Legs according to claim 1, characterized in that said attachment element (16) comprises a guide wall (20) for the rotation of said element for coupling with the tubular body (15) with respect to said support surface (14).

6. Legs according to claim 5, characterized in that said guide wall (20) has a beveled profile (22) in a plane of rotation (11) of said legs (10).

7. Legs according to claim 5, characterized in that said stable attachment means consists of two wedge-shaped elements (23) protruding laterally from said guide wall (20) and of tilted inner surfaces (26), matching said wedge-shaped elements (23) of said element for coupling with the tubular body (15), between said elements (23) a curved surface (23A) being foreseen.

8. Legs according to claim 1, characterized in that said central pressing surface (32) is concave.

9. Legs according to claim 1, characterized in that said engagement elements are trapezoidal fins (33) which ate symmetrical with respect to a plane of rotation (11).

10. Legs according to claim 1, characterized in that said through seats (30) are equipped with tilted planes (34) matching outlet edges (35) of said engagement elements (33).

11. Legs according to claim 1, characterized in that said element for coupling with the tubular body (15) and said attachment element (16) to a support surface (14) can be made both from metal and from plastic.

12. Legs according to claim 1, characterized in that said angle of inclination ($\alpha$) is a right angle.

13. Legs according to claim 1, characterized in that the joint (13) and relative components are all contained within the respective leg.

* * * * *